US011754365B1

(12) United States Patent
Chang

(10) Patent No.: US 11,754,365 B1
(45) Date of Patent: Sep. 12, 2023

(54) ANGLE-ADJUSTABLE STIRRUP ASSEMBLY OF A CROSSBOW

(71) Applicant: Combis Sport Enterprise Co., Ltd., Taichung (TW)

(72) Inventor: Chu-Wei Chang, Taichung (TW)

(73) Assignee: Combis Sport Enterprise Co., Ltd., Taichung (TW)

( * ) Notice: Subject to any disclaimer, the term of this patent is extended or adjusted under 35 U.S.C. 154(b) by 0 days.

(21) Appl. No.: 17/868,853

(22) Filed: Jul. 20, 2022

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01); *F41B 5/1453* (2013.01)

(58) Field of Classification Search
CPC ..... F41B 5/12; F41B 5/1453
See application file for complete search history.

(56) References Cited

U.S. PATENT DOCUMENTS

| | | | | |
|---|---|---|---|---|
| 8,161,956 | B2 * | 4/2012 | Bednar | F41A 23/06 124/25 |
| 9,303,945 | B1 | 4/2016 | Hughes et al. | |
| 9,310,153 | B2 * | 4/2016 | Nettleton | F41B 5/1453 |
| 9,464,861 | B1 | 10/2016 | Hughes et al. | |
| 9,746,276 | B2 | 8/2017 | Hughes et al. | |
| 10,794,658 | B2 * | 10/2020 | Walthert | F41B 5/12 |
| 11,320,232 | B1 * | 5/2022 | Chu | F41B 5/1469 |
| 2014/0283805 | A1 * | 9/2014 | Dunlop | F41B 5/1469 124/25 |

FOREIGN PATENT DOCUMENTS

| | | |
|---|---|---|
| TW | 201712293 A | 4/2017 |
| TW | M614732 U | 7/2021 |

* cited by examiner

*Primary Examiner* — John A Ricci
(74) *Attorney, Agent, or Firm* — Karin L. Williams; Alan D. Kamrath; Mayer & Williams PC

(57) ABSTRACT

An angle-adjustable stirrup assembly includes a connector, a stirrup, and a locking element. The connector includes a plate connected to a crossbow, a sleeve formed on a face of the plate, and recesses in an external face of the sleeve. The stirrup is pivotally connected to the sleeve and includes a first section, a second section in parallel to the first section, a slot in the first section, and a tread formed on the second section. The locking element includes an end pivotally connected to the stirrup and another end formed with a boss for insertion in a selected one of the recesses via the slot to keep the stirrup in a selected one of several angles relative to the connector.

17 Claims, 10 Drawing Sheets

B - B

ANGLE-ADJUSTABLE STIRRUP ASSEMBLY OF A CROSSBOW

BACKGROUND OF INVENTION

Field of Invention

The present invention relates to a crossbow and, more particularly, to an angle-adjustable stirrup assembly of a crossbow.

Related Prior Art

A conventional crossbow includes a rail, two limbs, and a string. Each of the limbs includes an internal end connected to the rail. The string includes two ends. Each of the ends of the string is tied to an external end of a corresponding one of the limbs. In operation, a user holds a portion of the crossbow with one hand and loads the string with another hand. This practice is inconvenient and exerts a heavy load on the user's arms.

To solve the foregoing problems, Taiwanese Patent Application Publication No. TW201712293 Å discloses a stirrup connected to a front end of the rail of the crossbow. The use of the stirrup allows the user to tread on it with a foot to secure the crossbow in position and load the strings with both hands. This practice is convenient and exerts a lighter load on the user's arms. However, the use of the stirrup increases a space for storing t crossbow.

To overcome the foregoing problem, Taiwanese Patent No. M614732 discloses an angle-adjustable stirrup for the crossbow in operation, the user synchronously translates two elements 30 with two fingers of a hand. However, this practice is inconvenient for requiring the user to adjust the angle of the stirrup with another hand.

The present invention is therefore intended to obviate or at least alleviate the problems encountered in the prior art.

SUMMARY OF INVENTION

It is the primary objective of the present invention to provide a crossbow with a convenient angle-adjustable stirrup assembly.

To achieve the foregoing objective, the angle-adjustable stirrup assembly includes a connector, a stirrup, and a locking element. The connector includes a plate connected to a crossbow, a sleeve formed on a face of the plate, and recesses in an external face of the sleeve. The stirrup is pivotally connected to the sleeve and includes a first section, a second section in parallel to the first section, a slot in the first section, and a tread formed on the second section. The locking element includes an end pivotally connected to the stirrup and another end formed with a boss for insertion in a selected one of the recesses via the slot to keep the stirrup in a selected one of several angles relative to the connector.

Other Objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
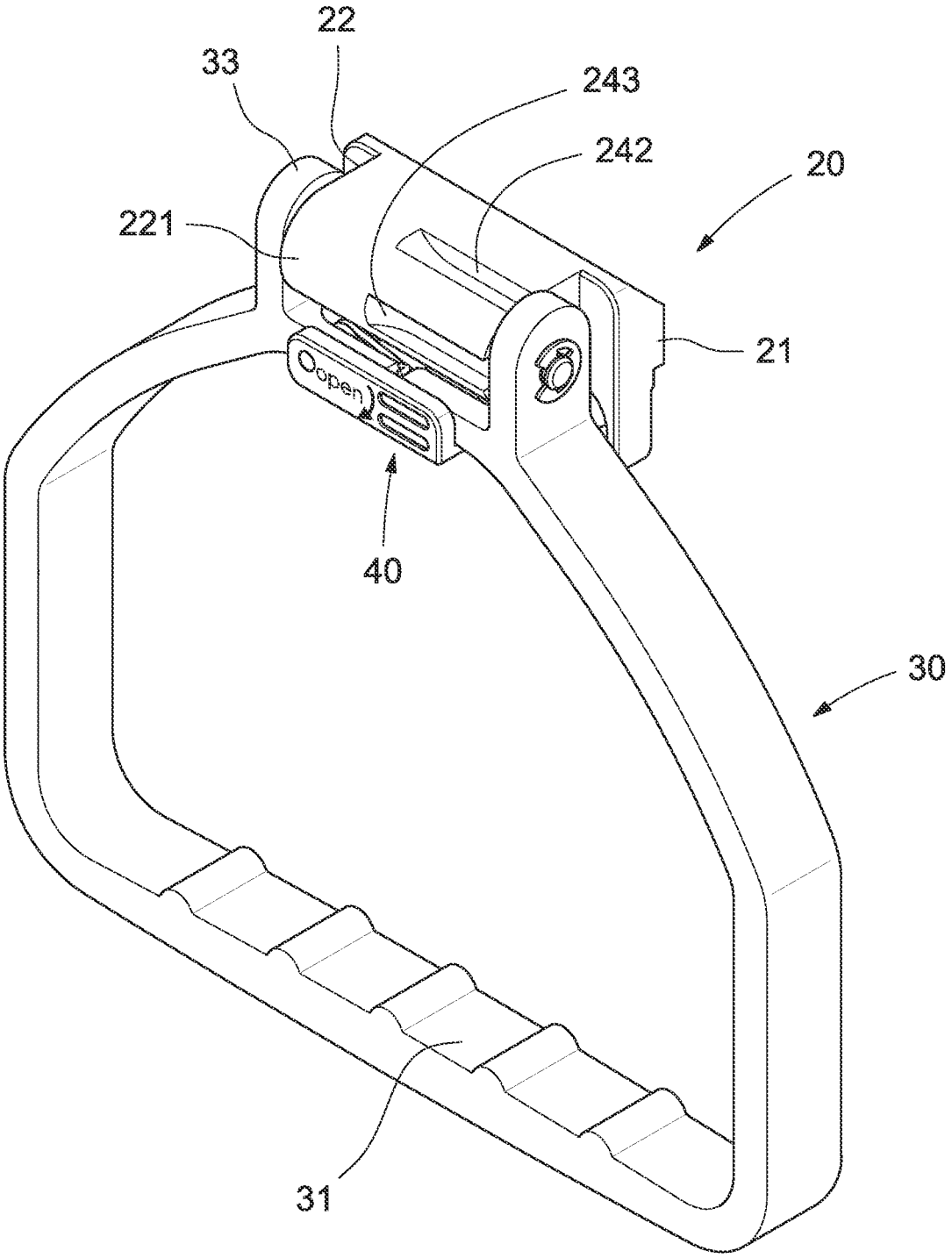
FIG. 1 is a perspective view of an angle-adjustable stirrup assembly according to the preferred embodiment of the present invention.
Figure 2:
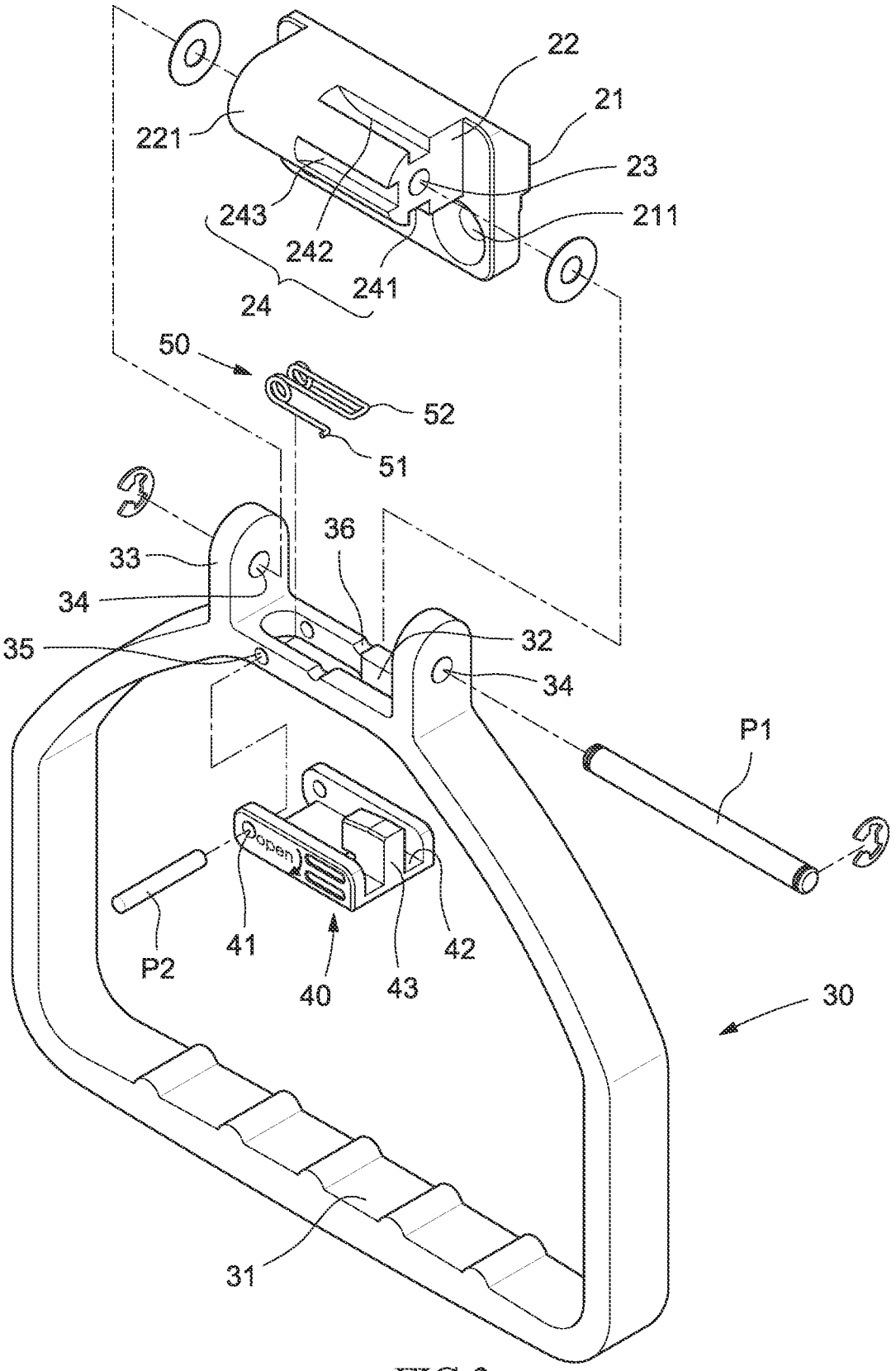
FIG. 2 is an exploded view of the angle-adjustable stirrup assembly shown in FIG. 1.

Referring to FIGS. 1 through 4, a crossbow 10 is equipped with an angle-adjustable stirrup assembly that includes a connector 20, a stirrup 30, a locking element 40, and a spring 50 according to the preferred embodiment of the present invention.

Figure 4:
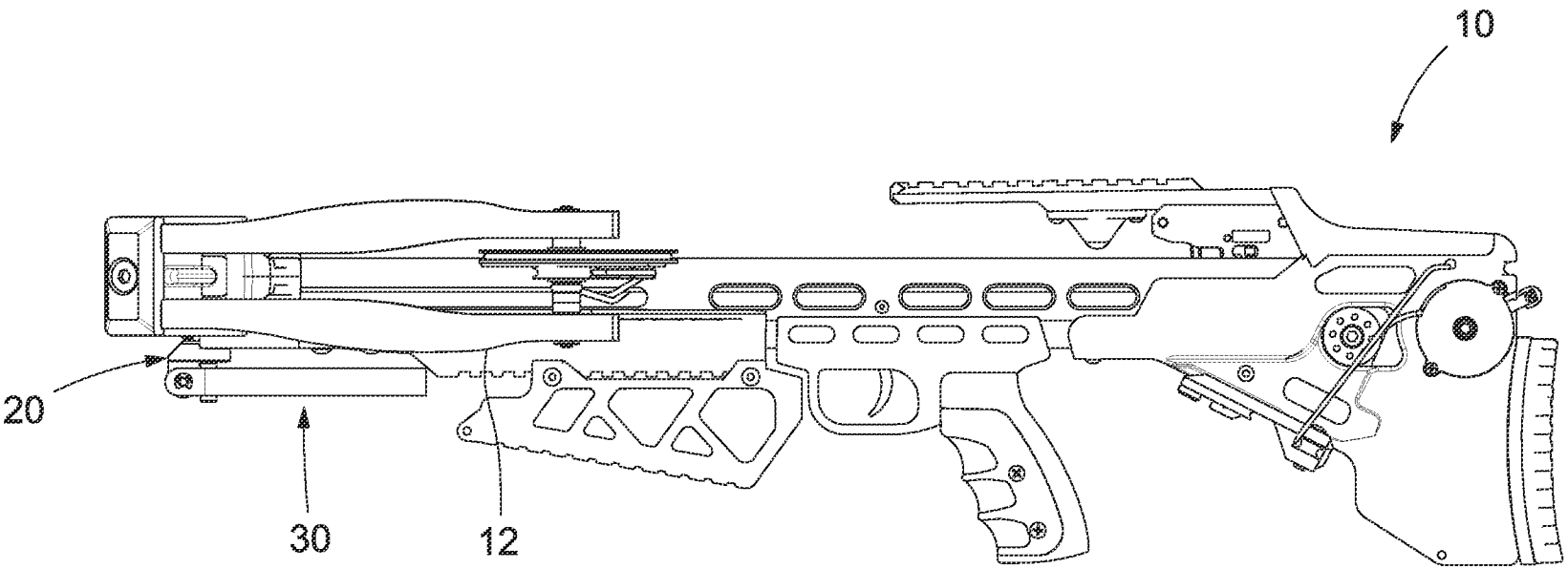
FIG. 4 is a side view of a crossbow equipped with the angle-adjustable stirrup assembly shown in FIG. 1.

The connector 20 is connected to a lower portion of a rail 12 of the crossbow 10 (FIG. 4). The connector 20 includes a plate 21, a sleeve 22, a tunnel 23, and a positioning unit 24.

The plate 21 includes multiple countersink holes 211. A fastener such as a screw (not shown) is driven in the rail 12 through each of the countersink holes 211 so that the plate 21 is connected to the rail 12.

The sleeve 22 is formed on a lower face of the plate 21. The sleeve 21 includes a convex face 221.

The tunnel 23 extends throughout the sleeve 22.

The positioning unit 24 includes three recesses 241, 242 and 243 in the convex face 221 for example. The recesses 241, 242 and 243 are evenly arranged about the tunnel 23, The recesses 241, 242 and 243 represent different angles of the stirrup 30 relative to the connector 20.

The stirrup 30 is pivotally connected to the connector 20. The stirrup 30 includes a tread 31, a slot 32, two lugs 33, two orifices 34, two bores 35, and two notches 36.

The tread 31 is a lower section of the stirrup 30, which is in the form of a frame. The tread 31 includes a rough internal face used as an anti-skid face.

The slot 32 is made in an upper section of the stirrup 30 located opposite to the tread 31. Thus, the lower section of the stirrup 30 includes two bars (not numbered) between which the slot 32 extends. In operation, the slot 32 is aligned to a selected one of the recesses 241, 242 and 243.

The lugs 33 extend from the upper section of the stirrup 30. The slot 32 is located between the lugs 33. Each of the orifices 34 is made in a corresponding one of the lugs 33.

In assembly, the sleeve 22 is located between the lugs 33, and a pivot P1 is inserted in the orifices 34 and the tunnel 23. Thus, the stirrup 30 is pivotally connected to the connector 20.

The upper section of the stirrup 30 includes two branches (not numbered) between which the slot 32 extends. Each of the bores 35 is made in a corresponding one of the branches of the upper section of the stirrup 30. The bores 35 are in communication with the slot 32.

Each of the notches 36 is made in an edge of a corresponding one of the branches of the upper section of the stirrup 30. The notches 36 face the sleeve 22.

At an end, the locking element 40 is pivotally connected to the upper section of the stirrup 30. At another end, the locking element 40 is engageable with the sleeve 22 to keep the stirrup 30 at a selected one of the angles relative to the connector 20.

The locking element 40 includes a base (not numbered), two walls (not numbered), two apertures 41, a cavity 42, and a boss 43.

The walls extend from an upper face of the base so that the cavity 42 is located between the walls and above the base. The walls are in parallel to each other.

Each of the apertures 41 is made in a corresponding one of the walls of the locking element 40. A pivot P2 is inserted in the apertures 41 and the bores 35 after the upper section of the stirrup 30 is inserted in the cavity 42, which is located between the walls of the locking element 40. Thus, the locking element 40 is pivotally connected to the stirrup 30.

The boss 43 extends from the upper face of the base of the locking element 40. The boss 43 is insertable in a selected one of the recesses 241, 242 and 243 to keep the stirrup 30 in a selected one of the angles relative to the connector 20. To this end, the boss 43 is compliant to the recesses 241, 242 and 243 in shape. Preferably, the boss 43 is a tab and the recesses 241, 242 and 243 are slits. The boss 43 includes a cutout 431 to be described.

Preferably, the spring 50 is a torque spring includes a middle section, two lateral sections, and two helical sections. Each of the helical sections is formed between the middle section and a corresponding one of the lateral sections. The pivot P2 is inserted in the helical sections of the spring 50. The middle section of the spring 50 is inserted in the cutout 431 of the boss 43. An end of each of the lateral sections of the spring 50 is inserted in a corresponding one of the notches 36. Thus, the spring 50 is loaded and tends to pivot the locking element 40 toward the upper section of the stirrup 30. That is, the spring 50 tends to keep the boss 43 in a selected one of the recesses 241, 242 and 243 via the slot 32.

Figure 5:
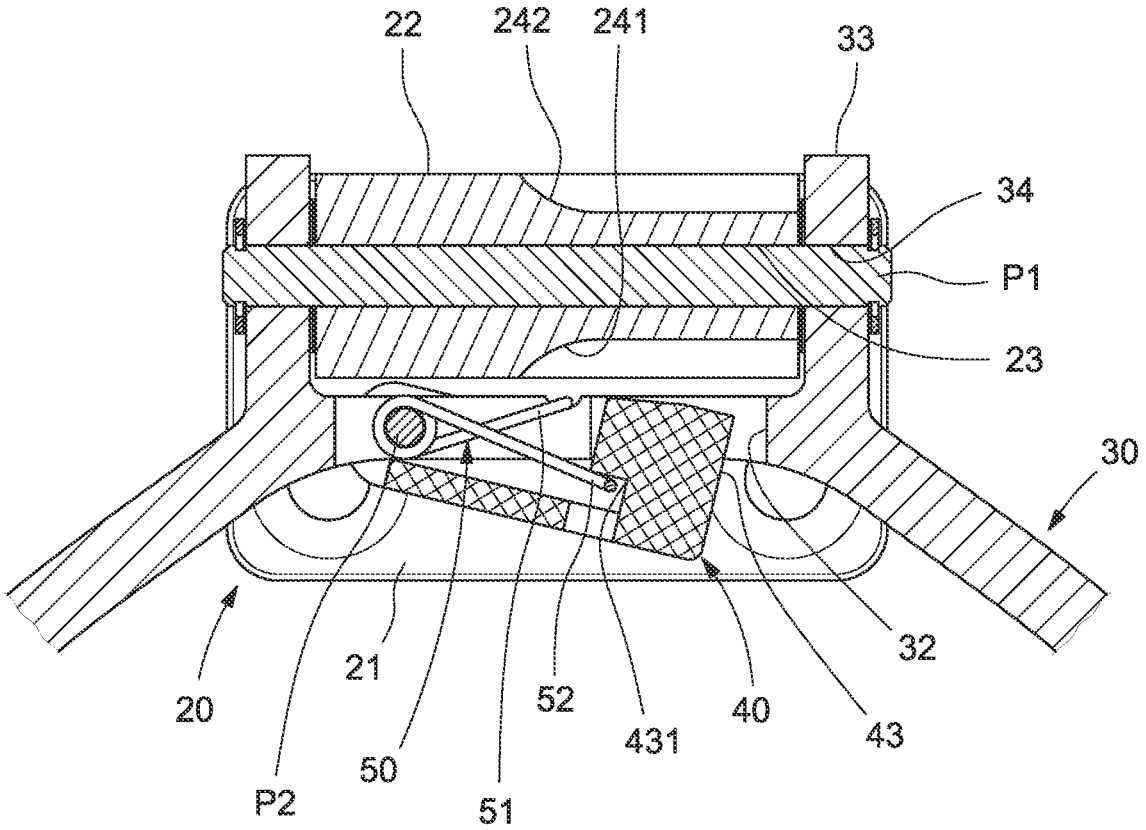
FIG. 5 is a cross-sectional view of the angle-adjustable stirrup assembly in another position than shown in FIG. 3.
Figure 7:
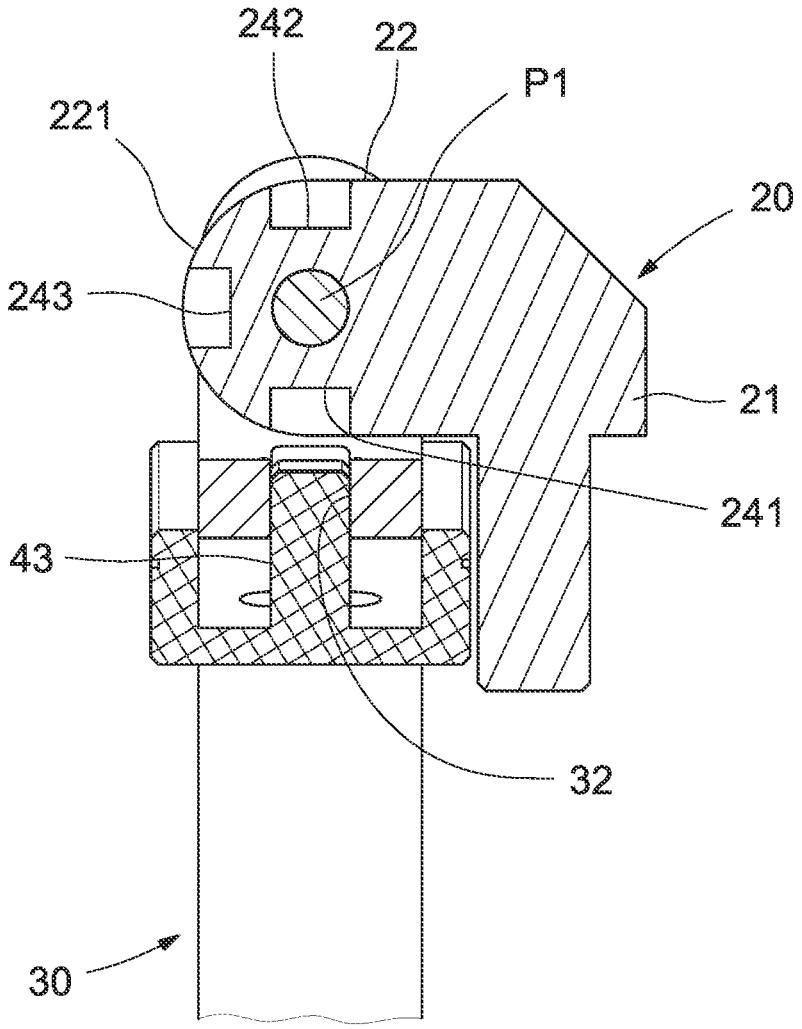
FIG. 7 is a cross-sectional view of the angle-adjustable stirrup assembly in another position than shown in FIG. 6.
Figure 8:
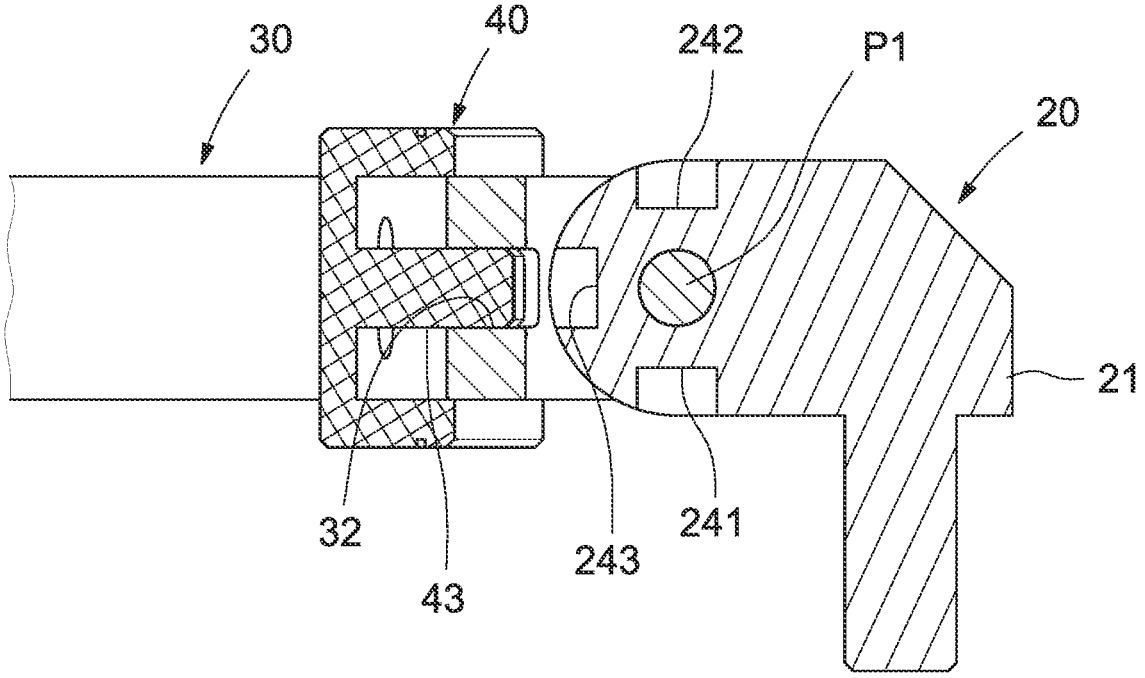
FIG. 8 is a cross-sectional view of the angle-adjustable stirrup assembly at another angle than shown in FIG. 7.

Referring to FIGS. 5, 7 and 8 in addition to FIGS. 1 through 4, the stirrup 30 is allowed to pivot freely relative to the connector 20 when the boss 43 is located out of the recesses 241, 242 and 243.

Figure 3:
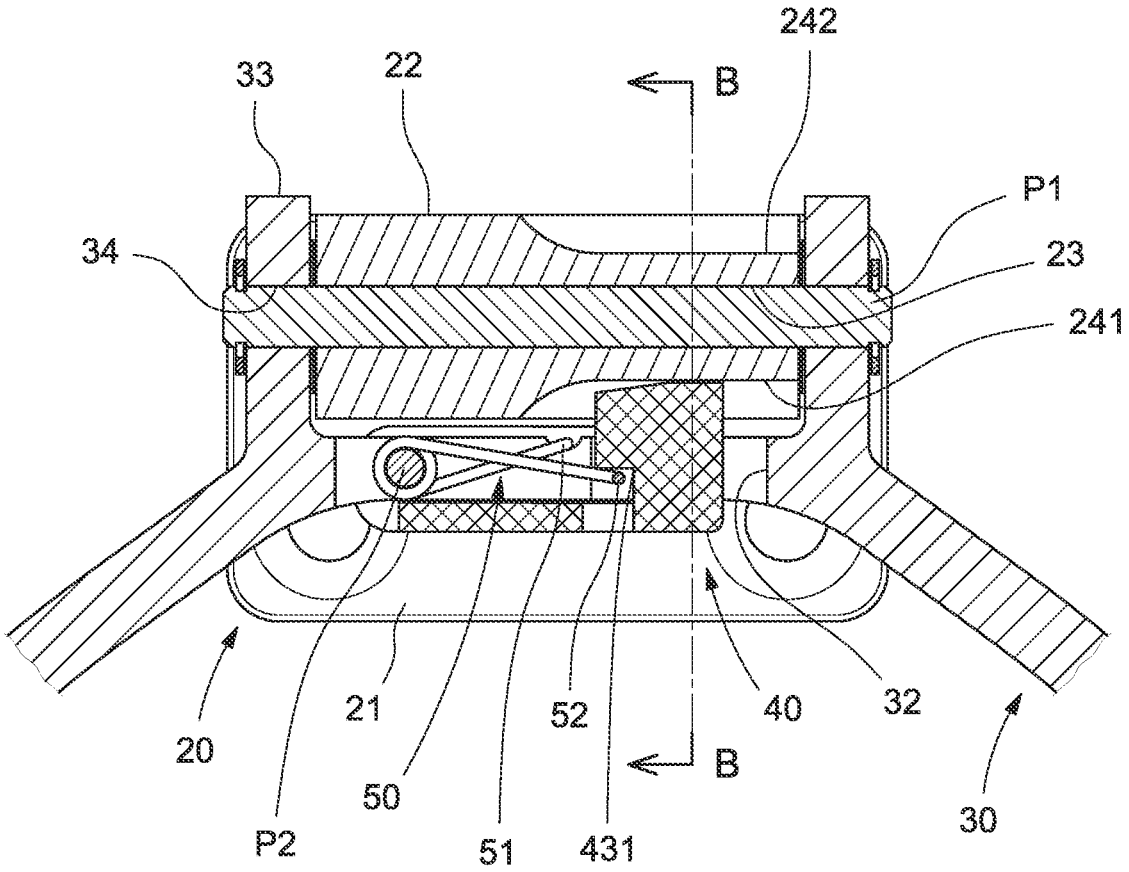
FIG. 3 is a cross-sectional view of the angle-adjustable stirrup assembly shown in FIG. 1.
Figure 6:
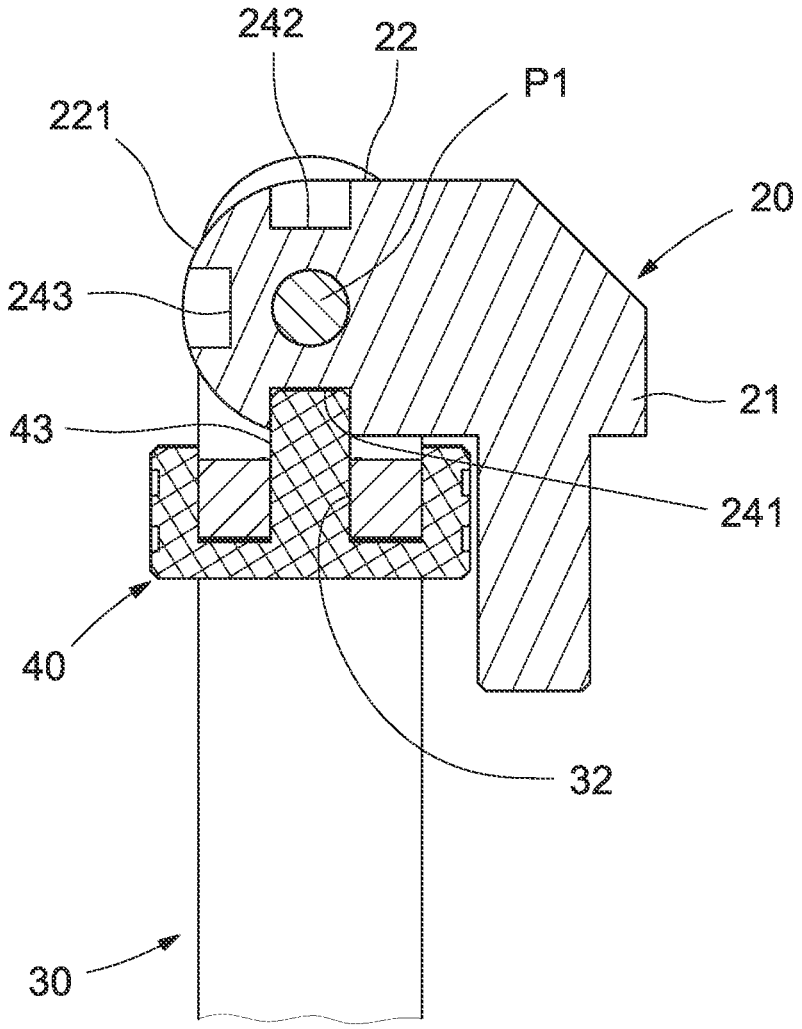
FIG. 6 is a cross-sectional view of the angle-adjustable stirrup assembly taken along a line B-B in another position than shown in FIG. 3.

Referring to FIG. 4, for storing the crossbow 10, the stirrup 30 is located against the rail 12, To keep the stirrup 30 in this angle relative to the connector 20, which is connected to the rail 12, the boss 43 is inserted in the recess 241 referring to FIGS. 3 and 6.

Figure 9:
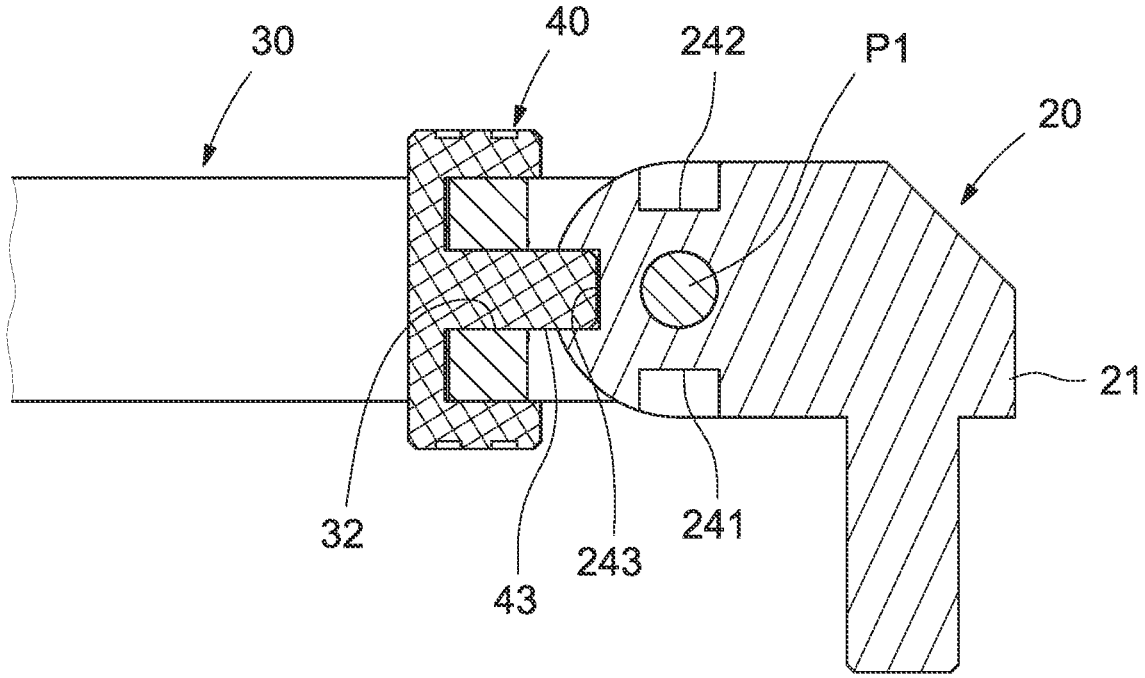
FIG. 9 is a cross-sectional view of the angle-adjustable stir up assembly at another angle than shown in FIG. 8.
Figure 10:
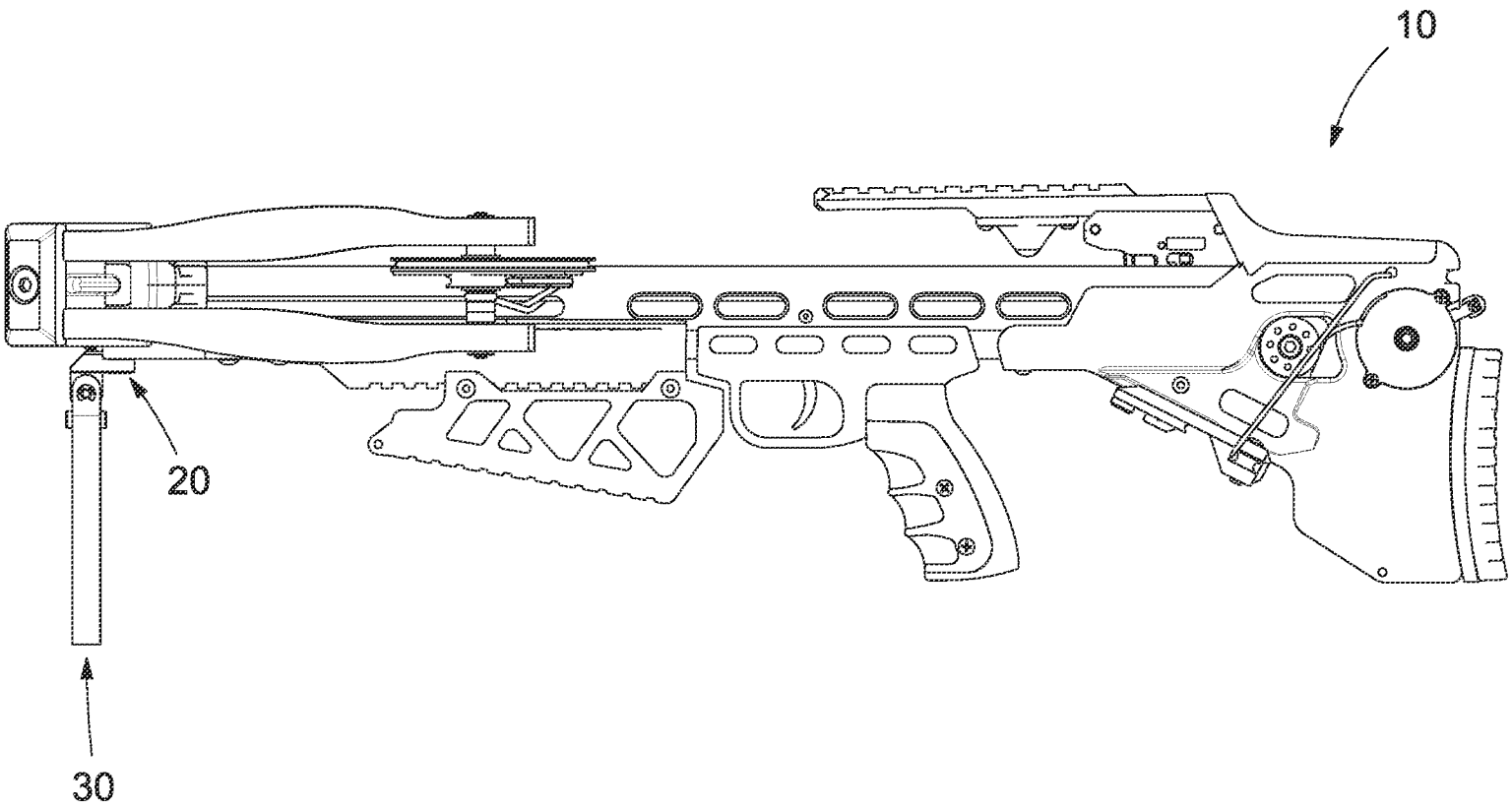
FIG. 10 is a side view of a crossbow equipped with the angle-adjustable stirrup assembly at another angle than shown in FIG. 4.

Referring to FIG. 10, the stirrup 30 of the crossbow 10 is used like a mount of a machine gun. To keep the stirrup 30 in this angle relative to the connector 20, which is connected to the rail 12, the boss 43 is inserted in the recess 243 referring to FIG. 9.

Figure 11:
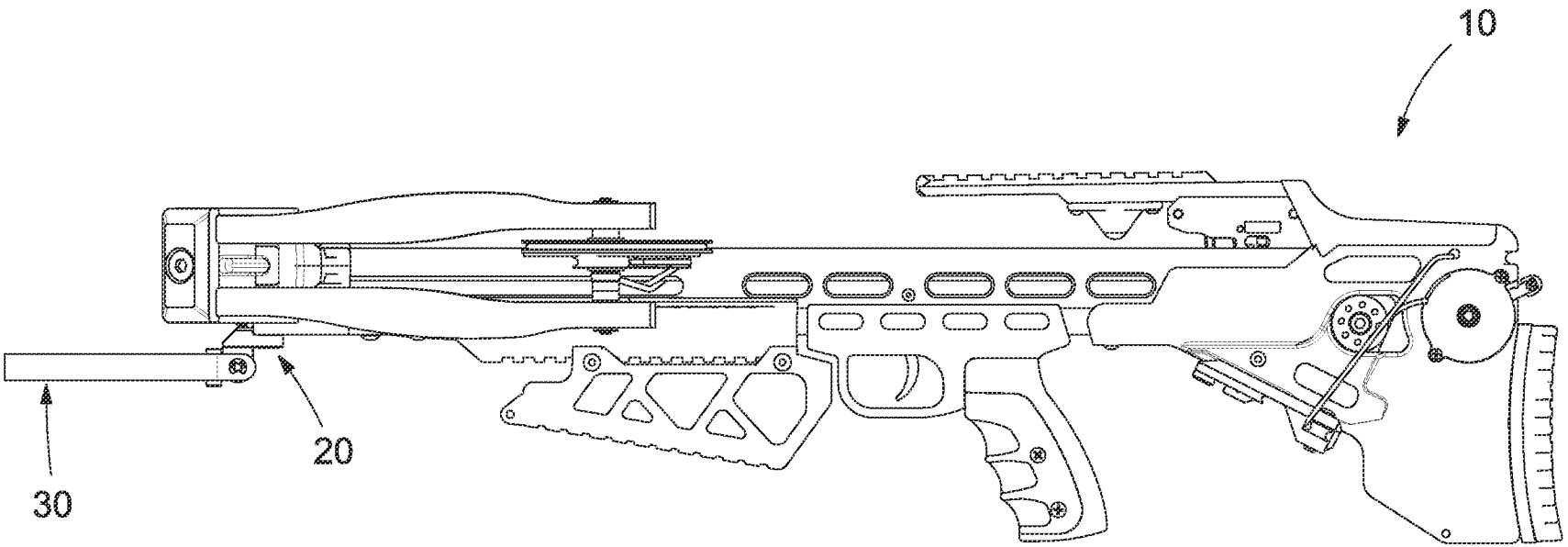
FIG. 11 is a side view of a crossbow equipped with the angle-adjustable stirrup assembly at another angle than shown in FIG. 10.

Referring to FIG. 11, for loading a string (not numbered) of the crossbow 110, the stirrup 30 is extended forward from the rail 12. To keep the stirrup 30 in this angle relative to the connector 20, which is connected to the rail 12, the boss 43 is inserted in the recess 242.

Advantageously, the angle-adjustable stirrup assembly allows a user to pivot the locking element 40 and the stirrup 30 with a single hand. The operation of the angle-adjustable stirrup assembly is convenient.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An angle-adjustable stirrup assembly comprising:

a connector comprising a plate connected to a crossbow, a sleeve formed on a face of the plate, and recesses in an external face of the sleeve;

a stirrup pivotally connected to the sleeve and comprising a first section, a second section in parallel to the first section, a slot in the first section, and a tread formed on the second section; and a locking element comprising an end pivotally connected to the stirrup and another end formed with a boss for insertion in a selected one of the recesses via the slot to keep the stirrup in a selected one of several angles relative to the connector.

2. The angle-adjustable stirrup assembly according to claim 1, wherein the external face of the sleeve is a convex face.

3. The angle-adjustable stirrup assembly according to claim 1, further comprising a pivot comprising a middle section inserted in the sleeve, and wherein the stirrup comprises two lugs for receiving two terminal sections of the pivot so that the stirrup is pivotally connected to the connector.

4. The angle-adjustable stirrup assembly according to claim 3, wherein the sleeve comprises a tunnel for receiving the pivot, and wherein each of the lugs comprises an orifice for receiving the pivot.

5. The angle-adjustable stirrup assembly according to claim 1, wherein the locking element comprises a cavity aligned to the slot, and wherein the boss extends from a bed of the cavity.

6. The angle-adjustable stirrup assembly according to claim 1, wherein the connector comprises two recesses in the external face of the sleeve.

7. The angle-adjustable stirrup assembly according to claim 6, wherein a line that travels through the recesses is in parallel to the face of the plate.

8. The angle-adjustable stirrup assembly according to claim 6, wherein the connector comprises another recess between the recesses.

9. The angle-adjustable stirrup assembly according to claim 1, further comprising a pivot inserted in the locking element and the stirrup, thereby pivotally connecting the locking element to the stirrup.

10. The angle-adjustable stirrup assembly according to claim 9, wherein the stirrup comprises two bores for receiving two sections of the pivot, and wherein the locking element comprises two apertures for receiving two other sections of the pivot.

11. The angle-adjustable stirrup assembly according to claim 10, wherein the bores are in communication with the slot.

12. The angle-adjustable stirrup assembly according to claim 11, wherein a line that travels through bores is in perpendicular to a length of the slot.

13. The angle-adjustable stirrup assembly according to claim 1, further comprises a spring for pivoting the locking element toward the first section of the stirrup, thereby keeping the boss in a selected one of the bosses.

14. The angle-adjustable stirrup assembly according to claim 13, wherein the spring comprises a first section connected to the stirrup and a second section connected to the locking element.

15. The angle-adjustable stirrup assembly according to claim 14, wherein the first section of the spring is connected to the first section of the stirrup, and wherein the second section of the spring is connected to the tab of the locking element.

16. The angle-adjustable stirrup assembly according to claim 15, wherein the first section of the stirrup comprises a notch for receiving the first section of the spring.

17. The angle-adjustable stirrup assembly according to claim 16, wherein the boss comprises a cutout for receiving the second section of the spring.

* * * * *